US011094153B2

(12) United States Patent
Einberg

(10) Patent No.: US 11,094,153 B2
(45) Date of Patent: Aug. 17, 2021

(54) CONTROLLING ACCESS TO A PHYSICAL SPACE USING A FINGERPRINT SENSOR

(71) Applicant: ASSA ABLOY AB, Stockholm (SE)

(72) Inventor: Fredrik Einberg, Huddinge (SE)

(73) Assignee: ASSA ABLOY AB, Stockholm (SE)

( * ) Notice: Subject to any disclaimer, the term of this patent is extended or adjusted under 35 U.S.C. 154(b) by 106 days.

(21) Appl. No.: 16/336,212

(22) PCT Filed: Sep. 26, 2017

(86) PCT No.: PCT/EP2017/074391
§ 371 (c)(1),
(2) Date: Mar. 25, 2019

(87) PCT Pub. No.: WO2018/060201
PCT Pub. Date: Apr. 5, 2018

(65) Prior Publication Data

US 2019/0213818 A1 Jul. 11, 2019

(30) Foreign Application Priority Data

Sep. 30, 2016 (EP) ..... 16191741

(51) Int. Cl.
*G07C 9/00* (2020.01)

(52) U.S. Cl.
CPC ..... *G07C 9/00563* (2013.01); *G07C 2009/00634* (2013.01); *G07C 2009/00769* (2013.01)

(58) Field of Classification Search
None
See application file for complete search history.

(56) References Cited

U.S. PATENT DOCUMENTS 6,374,652 B1 4/2002 Hwang
7,113,070 B2 9/2006 Deng et al.
(Continued)

FOREIGN PATENT DOCUMENTS

CN 1536308 10/2004
CN 102392551 3/2012
(Continued)

OTHER PUBLICATIONS

"Bluetooth Core Specification Version 4.0 Ready to Roll." Www.Businesswire.Com, Apr. 20, 2010, www.businesswire.com/news/home/20100420005520/en/Bluetooth-Core-Specification-Version-4.0-Ready-Roll. Accessed Sep. 1, 2020. (Year: 2010).*
(Continued)

*Primary Examiner* — Justin P. Misleh
(74) *Attorney, Agent, or Firm* — Sheridan Ross P.C.

(57) ABSTRACT

It is provided a lock device for controlling access to a physical space. The lock device comprises: an electronically controllable lock; and a handle comprising a fingerprint sensor for capturing a fingerprint of a finger presented to the fingerprint sensor and obtaining fingerprint data based on a captured fingerprint, wherein the handle is configured to communicate wirelessly with the electronically controllable lock to selectively control unlocking of the electronically controllable lock based on the fingerprint data. The handle is configured to identify a user from the captured fingerprint, wherein an identifier of the identified user is communicated wirelessly from the handle to the electronically controllable lock to enable the electronically controllable lock to evaluate whether to perform an unlocking action.

13 Claims, 4 Drawing Sheets

(56) References Cited

U.S. PATENT DOCUMENTS

| | | | | |
|---|---|---|---|---|
| 7,463,132 | B2 | 12/2008 | Deng et al. | |
| 7,818,984 | B2 | 10/2010 | Hwang | |
| 2005/0044909 | A1 | 3/2005 | Lange | |
| 2007/0234052 | A1 | 10/2007 | Campisi | |
| 2010/0073129 | A1 | 3/2010 | Pukari | |
| 2010/0109838 | A1 | 5/2010 | Fisher | |
| 2011/0090541 | A1 | 4/2011 | Harper | |
| 2011/0215921 | A1 | 9/2011 | Ben Ayed et al. | |
| 2013/0318361 | A1* | 11/2013 | Erickson | G06F 21/32 713/193 |
| 2014/0028439 | A1 | 1/2014 | Lien | |
| 2015/0027178 | A1 | 1/2015 | Scalisi | |
| 2015/0128667 | A1 | 5/2015 | Yoon et al. | |
| 2016/0055694 | A1 | 2/2016 | Saeedi et al. | |
| 2016/0241119 | A1* | 8/2016 | Keeler | H02K 33/00 |
| 2016/0260271 | A1 | 9/2016 | Belhadia et al. | |
| 2017/0242992 | A1* | 8/2017 | Olofsson | G06F 21/32 |

FOREIGN PATENT DOCUMENTS

| | | |
|---|---|---|
| CN | 202431079 | 9/2012 |
| CN | 202544511 | 11/2012 |
| CN | 202810357 | 3/2013 |
| CN | 202970179 | 6/2013 |
| CN | 203081040 | 7/2013 |
| CN | 203230263 | 10/2013 |
| CN | 203321128 | 12/2013 |
| CN | 103510761 | 1/2014 |
| CN | 203499499 | 3/2014 |
| CN | 203569973 | 4/2014 |
| CN | 203706280 | 7/2014 |
| CN | 104240342 | 12/2014 |
| CN | 204040632 | 12/2014 |
| CN | 204311835 | 5/2015 |
| CN | 204856653 | 12/2015 |
| CN | 105220962 | 1/2016 |
| CN | 101709611 | 5/2020 |
| JP | 4032500 | 1/2008 |
| JP | 4161531 | 10/2008 |
| KR | 101566673 | 11/2015 |
| WO | WO 01/03491 | 1/2001 |

OTHER PUBLICATIONS

International Search Report and Written Opinion prepared by the European Patent Office dated Dec. 4, 2017, for International Application No. PCT/EP2017/074391.

Written Opinion prepared by the European Patent Office dated Dec. 4, 2017, for International Application No. PCT/EP2017/074391.

International Preliminary Report on Patentability prepared by the European Patent Office dated Dec. 14, 2018, for International Application No. PCT/EP2017/074391.

Official Action with English Translation for China Patent Application No. 201780060180.4, dated Oct. 20, 2020, 26 pages.

* cited by examiner

CONTROLLING ACCESS TO A PHYSICAL SPACE USING A FINGERPRINT SENSOR

CROSS REFERENCE TO RELATED APPLICATIONS

This application is a national stage application under 35 U.S.C. 371 and claims the benefit of PCT Application No. PCT/EP2017/074391 having an international filing date of 26 Sep. 2017, which designated the United States, which PCT application claimed the benefit of European Patent Application No. 16191741.4 filed 30 Sep. 2016, the disclosure of each of which are incorporated herein by reference.

TECHNICAL FIELD

The invention relates to a lock device, a method, a computer program and a computer program product for controlling access to a physical space while using a fingerprint sensor.

BACKGROUND

Locks and keys are evolving from the traditional pure mechanical locks. These days, there are wireless interfaces for electronic locks, e.g. by interacting with a portable key device. For instance, Radio Frequency Identification (RFID) has been used as the wireless interface.

However, such locks require the use of a physical portable key. In order to make using a lock even more convenient, fingerprint based locks have been developed.

US 2014/0028439 A1 discloses a sensor-embedded door handle with fingerprint identification function. The door handle comprises a door lock integration unit; a door handle disposed on the door lock integration unit; a door lock disposed on the door lock integration unit and interconnected with the door handle; a fingerprint sensing unit disposed on the door handle; a power supply wakeup unit disposed on the door handle; and a setup unit disposed on the door lock integration unit.

US 2005/0044909 A1 discloses a knob cylinder with a cylinder housing on which at least one side a knob is pivotably mounted for operating a lock catch, and with an electronic control which upon access authorization operates electronic switch means or coupling means in order to enable and/or to create a rotating-connection between the knob and the lock catch. A biometric sensor which cooperates with the electronic control and scans a fingerprint to determine access rights is located on the knob.

However, the installation of fingerprint based locks is inconvenient and cumbersome.

SUMMARY

It is an object to provide a lock device with a fingerprint sensor which simplifies installation and deployment, e.g. when retrofitting a fingerprint sensor.

According to a first aspect, it is provided a lock device for controlling access to a physical space. The lock device comprises: an electronically controllable lock; and a handle comprising a fingerprint sensor for capturing a fingerprint of a finger presented to the fingerprint sensor and obtaining fingerprint data based on a captured fingerprint, wherein the handle is configured to communicate wirelessly with the electronically controllable lock to selectively control unlocking of the electronically controllable lock based on the fingerprint data. The handle is configured to identify a user from the captured fingerprint, wherein an identifier of the identified user is communicated wirelessly from the handle to the electronically controllable lock to enable the electronically controllable lock to evaluate whether to perform an unlocking action.

The handle may further be configured to, for each new fingerprint data, obtain a decryption key from the electronically controllable lock, decrypt template data using the decryption key and discard the decryption key; wherein the identification of the user from the captured fingerprint is performed based on the decrypted template data.

The decrypting of template data may comprise obtaining encrypted template data from storage in the handle prior to decrypting.

The identification of a user may be performed by comparing the captured fingerprint data with templates, wherein each template is associated with an identifier of a user.

The lock device may be configured such that wireless communication between the handle and the electronically controllable lock occurs using Bluetooth Low Energy, BLE.

The lock device may be configured such that any wireless communication between the handle and the electronically controllable lock is encrypted.

The lock device may further comprise an energy harvesting module being configured to convert mechanical energy from when a user turns the handle to electrical energy to be used for powering electronics of the handle.

The lock device may further be configured to use a second factor authentication.

The second factor authentication may comprise the use of at least one of a keypad, a touch screen, and an electronic key communication interface.

According to a second aspect, it is provided a method for controlling access to a physical space. The method is performed by a lock device comprising an electronically controllable lock and a handle comprising a fingerprint sensor.

The method comprises the steps of: capturing a fingerprint of a finger presented to the fingerprint sensor; obtaining fingerprint data based on the captured fingerprint; identifying, in the handle, a user from the captured fingerprint; communicating an identifier of the identified user wirelessly from the handle to the electronically controllable lock; and selectively controlling unlocking of the electronically controllable lock based on the fingerprint data and wireless communication between the handle and the electronically controllable lock.

The step of identifying a user may comprise the sub-steps, for each new fingerprint data, of: obtaining a decryption key from the electronically controllable lock; decrypting template data using the decryption key, yielding decrypted template data; matching the fingerprint data with the decrypted template data; and discarding the decryption key and the decrypted template data.

The step of decrypting template data may comprise obtaining encrypted template data from storage in the handle prior to decrypting.

The step of identifying a user comprises comparing the captured fingerprint data with templates, wherein each template is associated with an identifier of a user.

According to a third aspect, it is provided a computer program for controlling access to a physical space. The computer program comprises computer program code which, when run on a lock device comprising an electronically controllable lock and a handle comprising a fingerprint sensor causes the lock device to: capture a fingerprint of a finger presented to the fingerprint sensor; obtain fingerprint data based on the captured fingerprint; identify, in the handle, a user from the captured fingerprint; communicate an identifier of the identified user wirelessly from the handle to the electronically controllable lock; and selectively control unlocking of the electronically controllable lock based on the fingerprint data and wireless communication between the handle and the electronically controllable lock.

According to a fourth aspect, it is provided a computer program product comprising a computer program according to the third aspect and a computer readable means on which the computer program is stored.

According to a fifth aspect, it is provided a lock device for controlling access to a physical space, the lock device comprising: a processor; and a memory storing instructions that, when executed by the processor, cause the lock device to: capture a fingerprint of a finger presented to the fingerprint sensor; obtain fingerprint data based on the captured fingerprint; identify, in the handle, a user from the captured fingerprint; communicate an identifier of the identified user wirelessly from the handle to the electronically controllable lock; and selectively control unlocking of the electronically controllable lock based on the fingerprint data and wireless communication between the handle and the electronically controllable lock.

The instructions to identify a user step may comprise instructions that, when executed by the processor, cause the lock device to, for each new fingerprint data: obtain a decryption key from the electronically controllable lock; decrypt template data using the decryption key, yielding decrypted template data; match the fingerprint data with the decrypted template data; and discard the decryption key and the decrypted template data.

The instructions to decrypt template data may comprise instructions that, when executed by the processor, cause the lock device to obtain encrypted template data from storage in the handle prior to decrypting.

The instructions to identify a user may comprise instructions that, when executed by the processor, cause the lock device to compare the captured fingerprint data with templates, wherein each template is associated with an identifier of a user.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
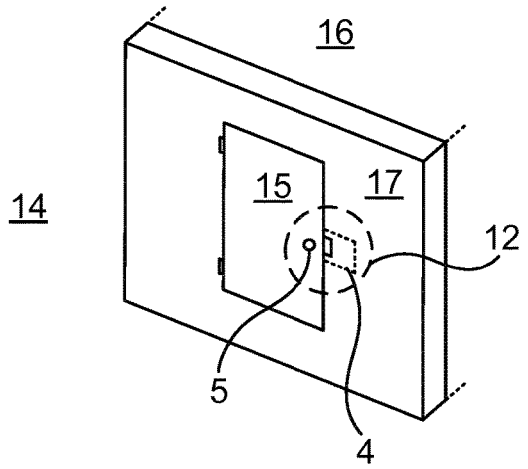
FIG. 1 is a schematic diagram showing an environment in which embodiments presented herein can be applied.

FIG. 1 is a schematic diagram showing an environment in which embodiments presented herein can be applied. Access to a physical space 16 is restricted by a physical barrier 15 which is selectively unlockable. The physical barrier 15 stands between the restricted physical space 16 and an accessible physical space 14. Note that the accessible physical space 14 can be a restricted physical space in itself, but in relation to this physical barrier 15, the accessible physical space 14 is accessible. The barrier 15 can be a door, gate, hatch, cabinet door, drawer, window, etc. In order to control access to the physical space 16, by selectively unlocking the barrier 15, a lock device 12 is provided. The lock device 12 comprises an electronically controllable lock 4 and a handle 5.

The electronically controllable lock 4 can be provided in the structure 17 surrounding the barrier 15 (as shown) or the electronically controllable lock 4 can be provided in the barrier 15 itself (not shown). The electronically controllable lock 4 is controllable to be in a locked state or in an unlocked state.

Significantly, the electronically controllable lock 4 communicates with the handle 5 over a wireless interface. The handle 5 comprises a fingerprint sensor which can capture a fingerprint of a presented finger. This allows selective controlled unlocking of the electronically controllable lock based on the captured fingerprint. In this way, as explained in more detail below, when a user presents a finger to the fingerprint sensor of the handle 5, an evaluation takes place to determine whether access should be granted or not. If this is the case, the lock device 12 grants access, whereby the electronically controllable lock 4 is set in an unlocked state.

Setting the electronically controllable lock 4 is set in an unlocked state can be implemented in a number of different ways. For instance, this can imply a signal to a lock controller (27 in FIG. 2) over a wire-based communication, e.g. using a serial interface (e.g. RS485, RS232), Universal Serial Bus (USB), Ethernet, or even a simple electric connection (e.g. to the lock device 12), or alternatively using a wireless interface. When the lock device 12 is in an unlocked state, the barrier 15 can be opened and when the lock device 12 is in a locked state, the barrier 15 cannot be opened. In this way, access to a restricted physical space 16 is controlled by the lock device 12.

Alternatively or additionally, when access is granted, the barrier can be triggered to be opened e.g. using a door opener.

Figure 2:
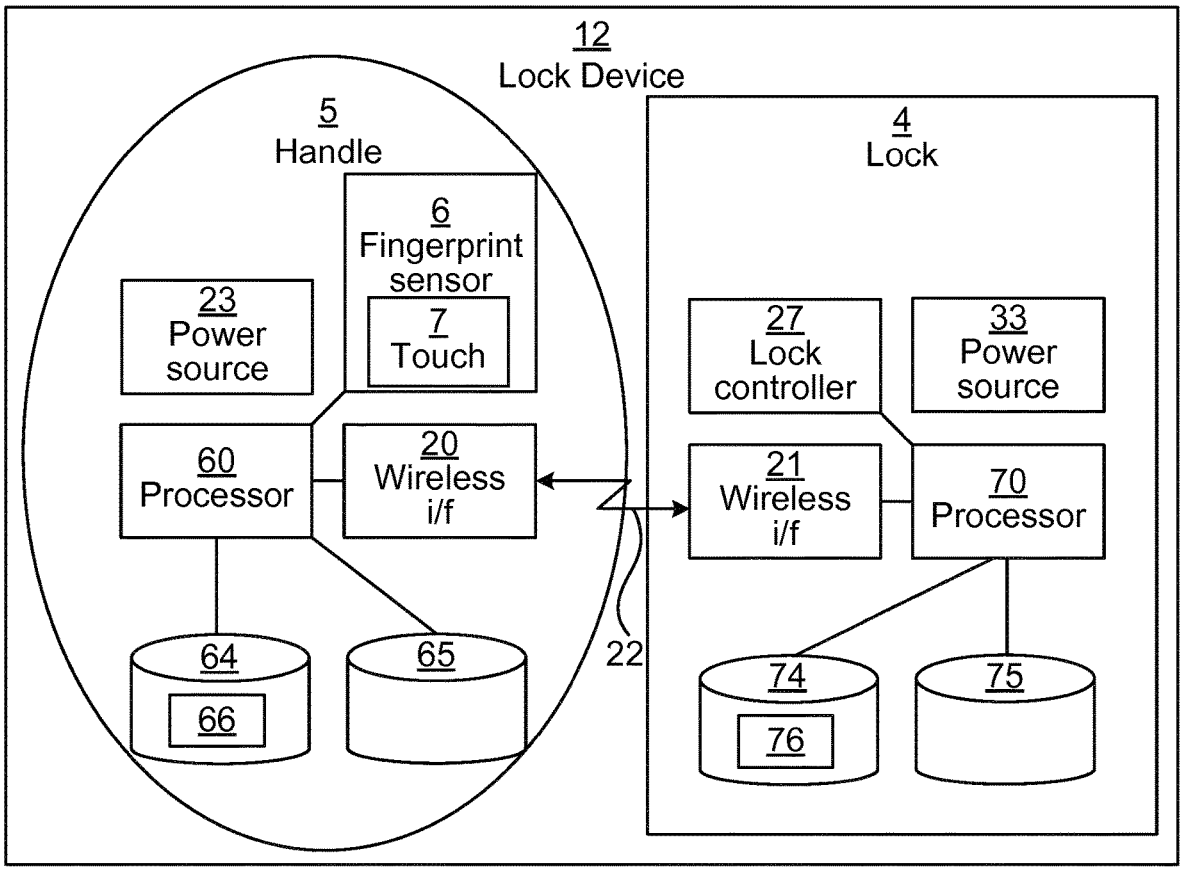
FIG. 2 is a schematic diagram illustrating the lock device of FIG. 1 in some more detail.

FIG. 2 is a schematic diagram illustrating the lock device 12 of FIG. 1 in some more detail. The lock device 12 comprises a handle 5 and an electronically controllable lock 4.

The handle 5 has an external structure which allows a user to turn the handle to make it rotate around an axis. For instance, the handle 5 can be in the form of a knob (i.e. with an outer shape which is essentially rotationally identical, appearing the same when rotated). Alternatively, the handle 5 comprises a lever which can simplifies the action of a user to achieve a rotational motion of the handle 5. The handle 5 comprises a fingerprint sensor 6, a touch sensor 7, a power source 23, a processor 60, a memory 64, a data memory 65, and a wireless communication interface 20.

The processor 60 controls the general operation of the handle 5. The processor 60 can be any combination of one or more of a suitable central processing unit (CPU), multiprocessor, microcontroller unit (MCU), digital signal processor (DSP), application specific integrated circuit (ASIC) etc., capable of executing software instructions or otherwise configured to behave according to predetermined logic. Hence, the processor 60 can be capable of executing software instructions 66 stored in a memory 64, which can thus be a computer program product. The processor 60 can be configured to execute parts of the method described with reference to FIG. 3A-B below, which relate to operations performed in the handle.

The memory 64 can be any combination of random access memory (RAM) and read only memory (ROM). The memory 64 also comprises persistent storage, which, for example, can be any single one or combination of magnetic memory, optical memory, solid state memory or even remotely mounted memory.

The data memory 65 is provided for reading and/or storing data during execution of software instructions in the processor 60, for instance data such as a captured fingerprint, fingerprint data, fingerprint templates for users for which access is allowed, etc. The data memory 65 can be any combination of random access memory (RAM) and read only memory (ROM).

The wireless interface 20 is used for communicating with other external entities such as the electronically controllable lock 4. The wireless interface 20 communicates over a wireless communication channel using one or more antennas. The wireless interface 20 supports wireless communication over any suitable wireless interface, e.g. using Bluetooth, Bluetooth Low Energy (BLE), any of the IEEE 802.15 standards, Radio Frequency Identification (RFID), Near Field Communication (NFC), any of the IEEE 802.11 standards, wireless USB, capacitively coupled human body interface like ISO17892, etc.

The fingerprint sensor 6 is provided to capture a fingerprint of a finger presented by a user. Optionally, additional user interface elements are provided (not shown), e.g. any one or more of a light emitting diodes (LED) or other lights, a display, keys or keypad, etc. Optionally, the fingerprint sensor comprises a touch sensor 7, which can be used to trigger a wake-up of the handle from a power saving sleeping state. The touch sensor could alternatively be provided separately from the fingerprint sensor on the handle 5.

The power source 23 provides electrical power to the handle 5, e.g. to the processor 60, memories 64, 65, wireless interface 20, fingerprint sensor 6, etc. The power source 23 can comprise a (disposable or rechargeable) battery and/or an energy harvesting module. The optional energy harvesting module can be used to convert mechanical energy from when a user turns the handle 5 to electrical energy.

The electronically controllable lock 4, in turn, also comprises a processor 70, a memory 74, a data memory 75 and a wireless interface 21. The electronically controllable lock 4 also comprises a lock controller 27 and a power source 33.

The processor 70 controls the general operation of the electronically controllable lock 4. The processor 70 can be any combination of one or more of a suitable central processing unit (CPU), multiprocessor, microcontroller unit (MCU), digital signal processor (DSP), application specific integrated circuit (ASIC) etc., capable of executing software instructions or otherwise configured to behave according to predetermined logic. Hence, the processor 70 can be capable of executing software instructions 76 stored in a memory 74, which can thus be a computer program product. The processor 70 can be configured to execute parts of the method described with reference to FIG. 3A-B below, which relate to operations performed in the electronically controllable lock 4.

The memory 74 can be any combination of random access memory (RAM) and read only memory (ROM). The memory 74 also comprises persistent storage, which, for example, can be any single one or combination of magnetic memory, optical memory, solid state memory or even remotely mounted memory.

The data memory 75 is provided for reading and/or storing data during execution of software instructions in the processor 70, for instance fingerprint data of a current user, fingerprint templates for users for which access is allowed, etc. The data memory 75 can be any combination of random access memory (RAM) and read only memory (ROM).

The wireless interface 21 is used for communicating with other external entities such as the handle 5. The wireless interface 21 communicates over a wireless interface using one or more antennas. The wireless interface 21 supports wireless communication over any suitable wireless interface, e.g. using Bluetooth, Bluetooth Low Energy (BLE), any of the IEEE 802.15 standards, Radio Frequency Identification (RFID), Near Field Communication (NFC), any of the IEEE 802.11 standards, wireless USB, capacitively coupled human body interface like ISO17892, etc. Optionally, a user interface (not shown) is also provided, e.g. comprising any one or more of a LEDs or other lights, a display, keys or keypad, etc.

The power source 33 provides electrical power to the electronically controllable lock 4, e.g. to the processor 70, memories 74, 75, wireless interface 21, lock controller 27, etc. The power source 33 can comprise a (disposable or rechargeable) battery, a connection to wired power distribution (e.g. mains power) and/or an energy harvesting module. When present, the energy harvesting module converts mechanical energy to electrical energy, e.g. based on a motion of the barrier or a motion of the handle.

The lock controller 27 allows an electronic signal to control the lock state of the electronically controllable lock 4, e.g. using a solenoid, coils, etc., as known in the art per se.

The handle 5 and the electronically controllable lock 4 communicate over a wireless channel 22 using their respective wireless interfaces 20, 21. The handle 5, comprising the fingerprint sensor 6, then communicates wirelessly over the wireless channel 22 with the electronically controllable lock 4 to selectively control unlocking of the electronically controllable lock based on the fingerprint data.

The fingerprint data can be a raw fingerprint image or a fingerprint template derived from a raw fingerprint image. The handle maps the fingerprint data to an identity of a user (or none if no match is found). The handle communicates the identity of the user (if a match is determined) to the electronic controllable lock device via the wireless interface.

The evaluation of whether the captured fingerprint is to result in an unlocking action is performed in the electronically controllable lock 4 based on the identifier of the user that the electronically controllable lock 4 receives from the handle over the wireless interface. Hence, the user identifier associated with the fingerprint data is communicated from the handle 5 to the electronically controllable lock 4.

Figure 3A:
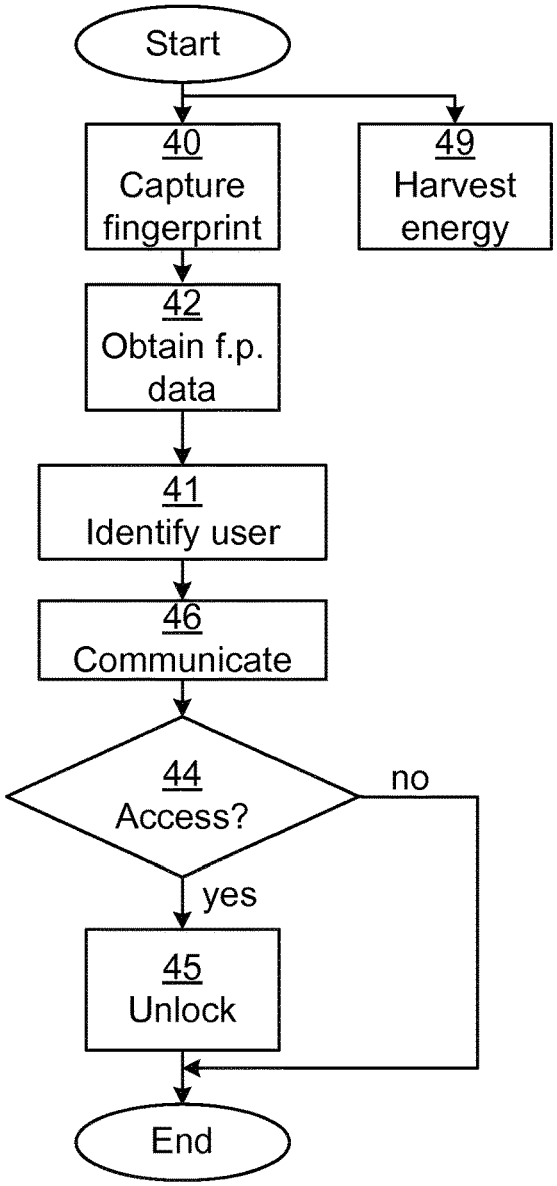
FIGS. 3A-B are flow charts illustrating embodiments of methods performed in the lock device of FIG. 1 for controlling access to a physical space.
Figure 3B:
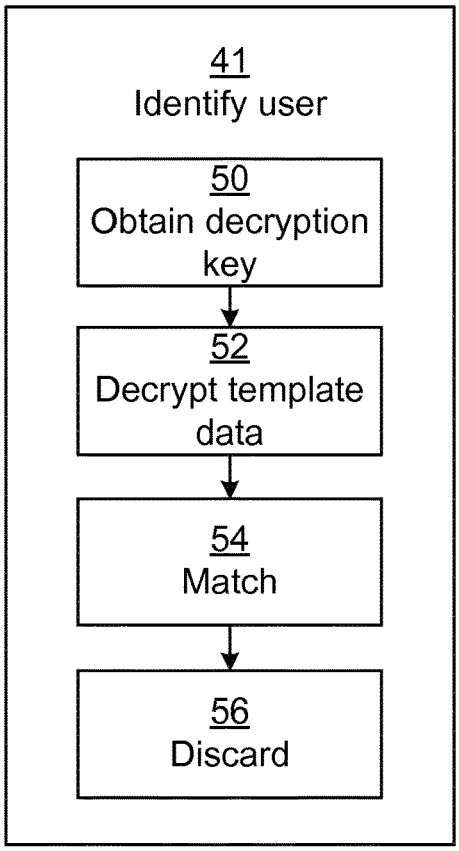

FIGS. 3A-B are flow charts illustrating embodiments of methods performed in the lock device of FIG. 1 for controlling access to a physical space. First, the flow chart of FIG. 3A will be described.

In a capture fingerprint step 40, a fingerprint of a finger presented to the fingerprint sensor is captured. The captured fingerprint can e.g. be in the form of a raw image. It is to be noted that when the fingerprint sensor is waiting to detect a finger, its power consumption is very low, in order to conserve energy.

In an obtain fingerprint ("f.p." in FIG. 3A) data step 42, fingerprint data based on the captured fingerprint is obtained. As explained above, the fingerprint data can simply be the raw fingerprint image which has been captured, or the fingerprint data can be a fingerprint template which the handle derives from the captured raw fingerprint image.

In an identify user step 41, the handle identifies a user from the captured fingerprint. This can be performed by comparing the captured fingerprint data with templates, wherein each template is associated with an identifier of a user. In any case, the identifier of the user is not the fingerprint data. In this way, the electronically controlled lock does not need to perform any fingerprint matching, which simplifies retrofitting of a fingerprint detecting handle. Each identifier can be in the form of an alphanumeric string.

In a communicate step 46, the handle communicates the identifier of the identified user wirelessly from to the electronically controllable lock.

In a conditional access step 44, the electronically controllable lock evaluates whether the electronically controllable lock is to be unlocked. This evaluation is indirectly based on the fingerprint data obtained in step 42, via the identifier of the user. The result of the access determination can be stored in an audit trail, which then comprises the identifier of the user.

Optionally, second factor authentication is also performed in a second factor authentication device, in order to improve security. The second factor authentication can e.g. be a Personal Identification Number (PIN) code, the use of an electronic key (e.g. as communicated over NFC, RFID or BLE), additional biometrics (e.g. iris identification, etc.). It is to be noted that the two types of authentications can be performed in either order. When the fingerprint authentication is performed after the other authentication, the fingerprint template associated with the identity found using the other authentication can be used to thereby further improve security. This is due to the number of acceptable fingerprint templates used for matching the current fingerprint template is drastically reduced. Also, the two authentications can be performed in different devices, such as in the handle and in the lock device.

In an unlock step 45, the electronically controllable lock is unlocked. The lock takes the access decision by comparing the identifier of the user obtained from the handle with a database containing valid user identities (i.e. the user identities which should be granted access), or a database otherwise containing indications of access rights for identifiers of users.

In an optional harvest energy step 49, an energy harvesting module of the lock device converts mechanical energy from when a user turns the handle to electrical energy to be used by the fingerprint sensor. This step is performed in parallel to the other steps of the method.

Looking now to FIG. 3B, some optional substeps of the identify user step 41 will be described. All of the substeps of FIG. 3B are performed for each new fingerprint data, i.e. each time a fingerprint is captured by the handle.

In an optional obtain decryption key step 50, the handle obtains a decryption key from the electronically controllable lock. For instance, the handle can request the decryption key from the electronically controllable lock over an already established connection (e.g. a BLE connection). The connection can be a connection which employs encryption to prevent eavesdropping by an attacker to get hold of the decryption key.

In an optional decrypt template data step 52, the handle decrypts template data using the decryption key, yielding decrypted template data. The template data is stored in the handle in encrypted form. Hence, this step then comprises obtaining encrypted template data from storage in the handle prior to decrypting. The decryption key and the decrypted template data is only stored in volatile memory, e.g. RAM, whereby the decryption key and the decrypted template data can not be retrieved if power to the decrypted template data is lost. Optionally, the handle is configured to lose power if it is removed from the rest of the lock device. For instance one connection path from the power source (e.g. battery) to the electronics of the handle may run through a conductive metal section of the rest of the lock device. In this way, if the handle is removed, power to the electronics is removed immediately and the decryption key and the decrypted template data is lost from the handle.

In an optional match step 54, the handle matches the fingerprint data with the decrypted template data. If there is no match, the method ends. Otherwise, when a match is found, the method continues with the matching user identifier of the matching template data.

In an optional discard step 56, the handle discards the decryption key and the decrypted template data.

Using the substeps illustrated by FIG. 3B, the template database is stored securely in encrypted form in the handle. Since the handle might be easier to steal by an attacker than the electronically controllable lock, it greatly increases security by only storing encrypted template data in the handle. Also, as described above, the handle can be configured such that power to the electronics (used for controlling the decrypted template data) is removed if an attacker detaches the handle from the rest of the lock device. Hence, the attacker will not get access to the decryption key or the decrypted template data, which could otherwise be used to spoof a fingerprint matching valid users.

The methods presented in FIGS. 3A-B utilize wireless communication between the electronically controllable lock and the handle. By utilizing wireless communication between the handle (containing the fingerprint sensor) and the electronically controllable lock, installation and deployment of the lock device is significantly simplified. No wires need to be installed from the handle which can then easily accommodate the fingerprint sensor. Optionally, the wireless interface supports encrypted communication with the electronically controllable lock to further increase security. Moreover, the handle is provided with all fingerprint identification data, whereby the identifier of the user is communicated to the electronically controllable lock. In this way, minimal or no changes are needed to the electronically controllable lock when the handle is retrofitted to an existing installation to provide fingerprint unlock capability. In other words, the electronically controllable lock does not need to know anything with regard to fingerprint matching; the electronically controllable lock only communicates with the handle, e.g. using the same protocol which has previously been used for communication with wireless credentials (e.g. over BLE).

The handle is the most convenient position of the fingerprint sensor, since the user needs to manoeuvre the handle anyway.

This wireless communication can e.g. occur using BLE, which is particularly energy efficient. This reduces the energy requirements in the handle and the electronically controllable lock, allowing the use of energy harvesting and/or batteries to be sufficient for powering the lock device. Thus, the need for expensive and inconvenient wired power connections, such as to a mains connection, is reduced.

Figure 4:
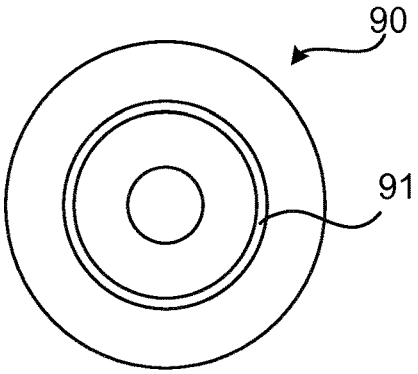
FIG. 4 shows one example of a computer program product comprising computer readable means.

FIG. 4 shows one example of a computer program product 90 comprising computer readable means. On this computer readable means a computer program 91 can be stored, which computer program can cause a processor to execute a method according to embodiments described herein. In this example, the computer program product 90 is an optical disc, such as a CD (compact disc) or a DVD (digital versatile disc) or a Blu-Ray disc. As explained above, the computer program product 90 could also be embodied in a memory of a device, such as the computer program products 64, 74 of FIG. 2. While the computer program 91 is here schematically shown as a track on the depicted optical disk, the computer program can be stored in any way which is suitable for the computer program product 90, such as a removable solid state memory, e.g. a Universal Serial Bus (USB) drive.

Figure 5:
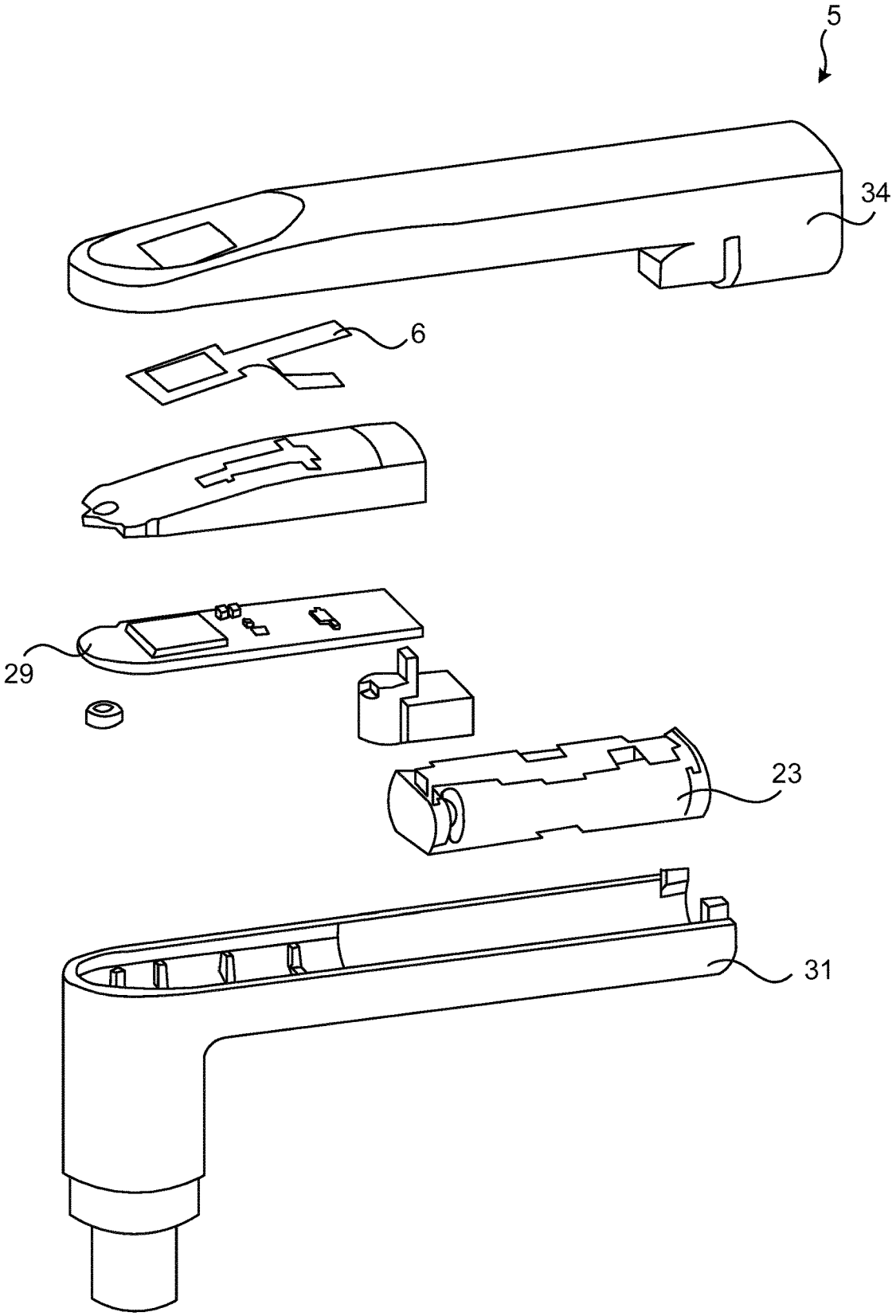
FIG. 5 is a schematic exploded view of a physical structure of the handle of FIG. 1 according to one embodiment.

FIG. 5 is a schematic exploded view of a physical structure of the handle 5 of FIG. 1 according to one embodiment. A base piece 31 is provided functioning as a housing for the electronic components of the handle, including the power source 23 (a battery in this example), a circuit board 29 and the fingerprint sensor. The circuit board comprises components for the processor 60, memories 64, 65 and the wireless interface 20. An outer piece 34 engages with the base piece to keep all the components securely in the handle 5. FIG. 5 also shows a number of mechanical support components which do not have reference numerals.

Figure 6:
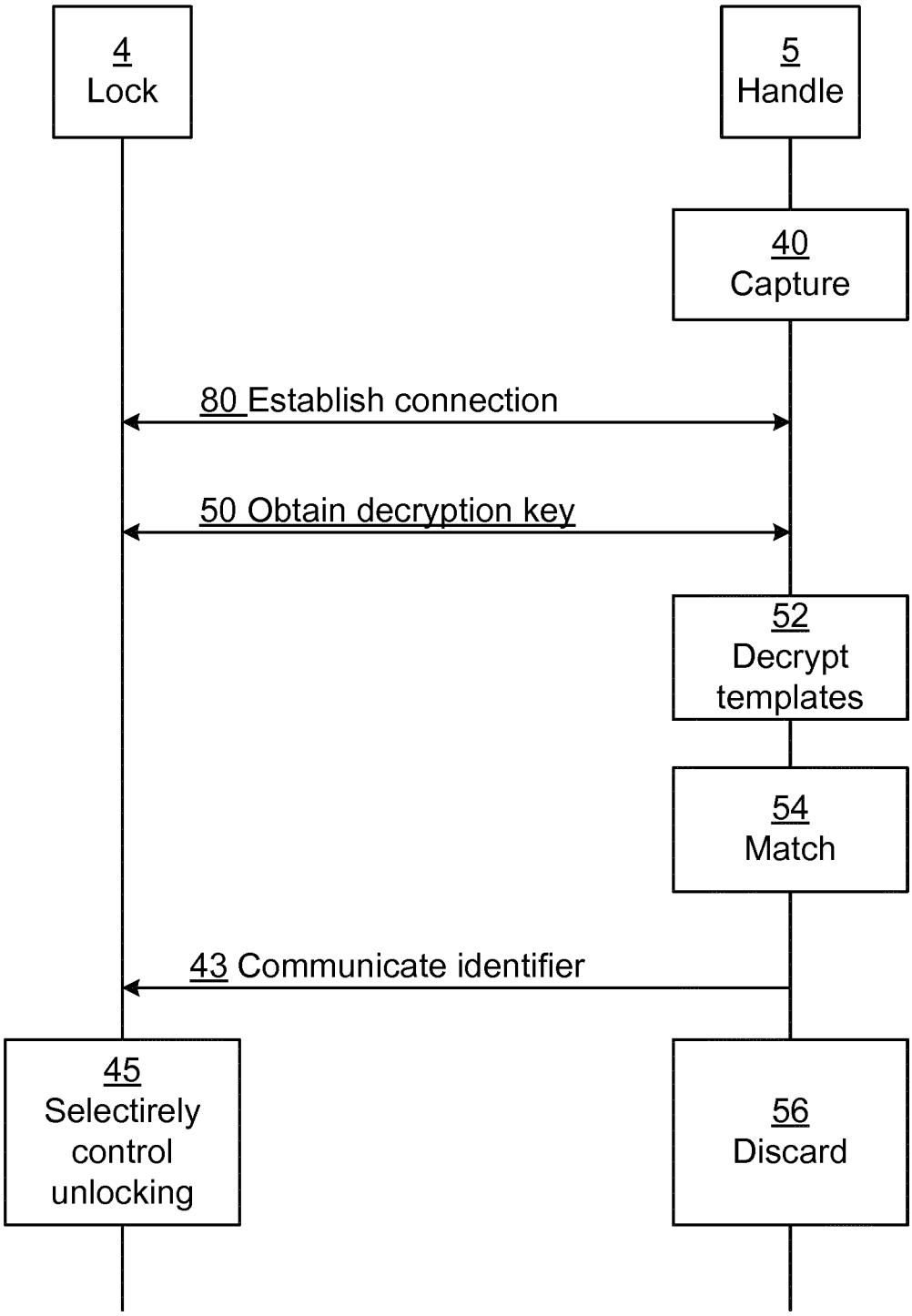
FIG. 6 is a sequence diagram illustrating communication between the electronically controllable lock and the handle of FIG. 2 according to one embodiment.

FIG. 6 is a sequence diagram illustrating communication between the electronically controllable lock 4 and the handle 5 of FIG. 2 according to one embodiment. The communication follows embodiments presented above with reference to FIGS. 3A-B.

The handle 5 captures 40 the fingerprint as described above. Furthermore, the handle establishes a connection 80 with the electronically controllable lock 4. This can be achieved e.g. using BLE, including a handshake protocol which results in an encrypted communication channel between the handle 5 and the electronically controllable lock 4 as known in the art per se. It is to be noted that the establishing connection 80 may occur prior to the capturing 40. Optionally, the communication channel can be reused for several instances of fingerprint capturing 40.

The handle then obtains the decryption key 50 from the lock and uses this to decrypt the encrypted template data as described in more detail above. Once the decrypted template data is available, the handle can match 54 the fingerprint data against the template data to determine whether there is a match. If there is no match, no more processing is performed apart from the discarding 54 of the decryption key and the decrypted template data. If there is a match, the handle communicates 43 the identifier of the matching user to the electronically controllable lock 4. At this point, the electronically controllable lock 4 can selectively control unlocking 45 using the identifier.

Here now follows a list of embodiments from another perspective, enumerated with roman numerals.

i. A lock device for controlling access to a physical space, the lock device comprising:

an electronically controllable lock; and a handle comprising a fingerprint sensor for capturing a fingerprint of a finger presented to the fingerprint sensor and obtaining fingerprint data based on a captured fingerprint, wherein the handle is configured to communicate wirelessly with the electronically controllable lock to selectively control unlocking of the electronically controllable lock based on the fingerprint data.

ii. The lock device according to embodiment i, wherein the handle is configured to evaluate whether the captured fingerprint is to result in an unlocking action, and to communicate an unlock command to the electronic controllable lock device via the wireless interface when the evaluation is positive.

iii. The lock device according to embodiment i or ii, wherein the handle is configured to identify a user from the captured fingerprint.

iv. The lock device according to embodiment iii, wherein an identifier of the identified user is communicated wirelessly from the handle to the electronically controllable lock, to enable the electronically controllable lock to evaluate whether to perform an unlocking action.

v. The lock device according to embodiment i, wherein the electronically controllable lock is configured to receive fingerprint data from the handle to enable the electronically controllable lock to evaluate whether the captured fingerprint is to result in an unlocking action.

vi. The lock device according to any one of the preceding embodiments, configured such that wireless communication between the handle and the electronically controllable lock occurs using Bluetooth Low Energy, BLE.

vii. The lock device according to any one of the preceding embodiments, configured such that any wireless communication between the handle and the electronically controllable lock is encrypted.

viii. The lock device according to any one of the preceding embodiments, further comprising an energy harvesting module being configured to convert mechanical energy from when a user turns the handle to electrical energy to be used for powering electronics of the handle.

ix. The lock device according to any one of the preceding embodiments, further being configured to use a second factor authentication.

x. The lock device according to embodiment ix, wherein the second factor authentication comprises the use of at least one of a keypad, a touch screen, and an electronic key communication interface.

xi. A method for controlling access to a physical space, the method being performed by a lock device comprising an electronically controllable lock and a handle comprising a fingerprint sensor, the method comprising the steps of:

capturing a fingerprint of a finger presented to the fingerprint sensor;

obtaining fingerprint data based on the captured fingerprint; and selectively controlling unlocking of the electronically controllable lock based on the fingerprint data and wireless communication between the handle and the electronically controllable lock.

xii. The method according to embodiment xi, wherein the step of selectively controlling unlocking comprises evaluating, by the handle, whether a captured fingerprint is to result in an unlocking action.

xiii. The method according to embodiment xi, wherein the step of selectively controlling unlocking comprises the substep of:

receiving, in the electronically controllable lock, fingerprint data from the handle; and wherein the step of selectively controlling comprises evaluating, in the electronically controllable lock, whether a captured fingerprint is to result in an unlocking action.

xiv A computer program for controlling access to a physical space, the computer program comprising computer program code which, when run on a lock device comprising an electronically controllable lock and a handle comprising a fingerprint sensor causes the lock device to:

capture a fingerprint of a finger presented to the fingerprint sensor;

obtain fingerprint data based on the captured fingerprint; and selectively control unlocking of the electronically controllable lock based on the fingerprint data and wireless communication between the handle and the electronically controllable lock.

xv. A computer program product comprising a computer program according to embodiment xiv and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A lock device for controlling access to a physical space protected by a barrier, the lock device comprising:

an electronically controllable lock; and a handle comprising a fingerprint sensor for capturing a fingerprint of a finger presented to the fingerprint sensor and obtaining fingerprint data based on a captured fingerprint, wherein the handle is configured to communicate wirelessly with the electronically controllable lock, and wherein the handle comprises at least one of a door knob and a lever;

wherein the handle is configured to identify a user from the fingerprint data, wherein the handle is configured to wirelessly communicate an identifier of the identified user to the electronically controllable lock;

wherein the electronically controllable lock is further configured to selectively control unlocking of the electronically controllable lock based on the identifier.

2. The lock device according to claim 1, wherein the handle is further configured to, for each new fingerprint data, obtain a decryption key from the electronically controllable lock, decrypt template data using the decryption key and discard the decryption key; wherein the identification of the user from the captured fingerprint is performed based on the decrypted template data.

3. The lock device according to claim 2, wherein the decrypting of template data comprises obtaining encrypted template data from storage in the handle prior to decrypting.

4. The lock device according to claim 1, wherein the identification of a user is performed by comparing the captured fingerprint data with templates, wherein each template is associated with an identifier of a user.

5. The lock device according to claim 1, configured such that wireless communication between the handle and the electronically controllable lock occurs using Bluetooth Low Energy, BLE.

6. The lock device according to claim 1, configured such that any wireless communication between the handle and the electronically controllable lock is encrypted.

7. The lock device according to claim 1, further comprising an energy harvesting module being configured to convert mechanical energy from when a user turns the handle to electrical energy to be used for powering electronics of the handle.

8. The lock device according to claim 1, further being configured to use a second factor authentication.

9. The lock device according to claim 8, wherein the second factor authentication comprises the use of at least one of a keypad, a touch screen, and an electronic key communication interface.

10. The lock device according to claim 1, wherein the handle comprises the door knob.

11. The lock device according to claim 1, wherein the handle comprises the lever.

12. The lock device according to claim 1, wherein the electronically controllable lock is provided in the barrier or a structure surrounding the barrier.

13. The lock device according to claim 1, wherein the handle wirelessly communicates with the electronically controllable lock using a protocol employed by the electronically controllable lock for communication with wireless credentials.

* * * * *